US006955743B2

(12) United States Patent
Rousu et al.

(10) Patent No.: US 6,955,743 B2
(45) Date of Patent: Oct. 18, 2005

(54) METHOD FOR PRODUCING FURFURAL, ACETIC ACID AND FORMIC ACID FROM SPENT PULP-COOKING LIQUOR

(75) Inventors: Esa Rousu, Oulu (FI); Pasi Rousu, Oulu (FI); Juha Anttila, Oulu (FI); Juha Tanskanen, Oulu (FI); Päivi Rousu, Oulu (FI)

(73) Assignee: Chempolis Oy (FI)

( * ) Notice: Subject to any disclaimer, the term of this patent is extended or adjusted under 35 U.S.C. 154(b) by 77 days.

(21) Appl. No.: 10/465,955

(22) PCT Filed: Dec. 28, 2001

(86) PCT No.: PCT/FI01/01158

§ 371 (c)(1),
(2), (4) Date: Jun. 27, 2003

(87) PCT Pub. No.: WO02/053829

PCT Pub. Date: Jul. 11, 2002

(65) Prior Publication Data

US 2004/0040830 A1 Mar. 4, 2004

(30) Foreign Application Priority Data

Dec. 29, 2000 (FI) ..... 20002886

(51) Int. Cl.[7] ..... B01D 3/34; D21C 3/04; D21C 3/20

(52) U.S. Cl. ..... 203/62; 203/16; 203/17; 203/77; 203/78; 203/79; 203/80; 159/47.3; 159/901; 159/DIG. 20; 162/16; 162/38; 162/76; 549/490; 562/608; 562/609

(58) Field of Search ..... 203/1, 62, 75–80, 203/14–17; 159/47.3, 901, DIG. 20; 162/16, 38, 76; 549/490; 562/608, 609

(56) References Cited

U.S. PATENT DOCUMENTS

| | | | | | |
|---|---|---|---|---|---|
| 4,088,660 | A | | 5/1978 | Puurunen | |
| 4,155,804 | A | * | 5/1979 | Edge, Jr. | 162/16 |
| 4,401,514 | A | | 8/1983 | Kanzler et al. | |
| 6,139,683 | A | * | 10/2000 | Nimz et al. | 162/19 |
| 6,562,191 | B1 | * | 5/2003 | Rousu et al. | 162/38 |

FOREIGN PATENT DOCUMENTS

| | | | |
|---|---|---|---|
| FI | C 54923 | | 4/1979 |
| WO | WO 96/25553 | | 8/1996 |
| WO | WO 99/57364 | | 11/1999 |
| WO | 00/47569 | * | 8/2000 |
| WO | WO 00/68494 | | 11/2000 |

* cited by examiner

*Primary Examiner*—Virginia Manoharan
(74) *Attorney, Agent, or Firm*—Alston & Bird LLP

(57) ABSTRACT

The invention relates to a process for recovering and producing chemicals in a pulp production process where organic chemicals, such as formic acid and acetic acid, are used as cooking chemicals. The process of the invention is based on regeneration of cooking acids and formation of additional cooking acids and furfural by evaporating the cooking liquor and then separating acetic acid, formic acid, furfural and water. The separation is preferably carried out by distillation using the furfural formed in the process as a distilling aid in the distillation.

32 Claims, 1 Drawing Sheet

METHOD FOR PRODUCING FURFURAL, ACETIC ACID AND FORMIC ACID FROM SPENT PULP-COOKING LIQUOR

CROSS-REFERENCE TO RELATED APPLICATIONS

This application is a national stage filing of International Application PCT/FI01/01158 filed on Dec. 28, 2001, which designated the U.S. and was published under PCT Article 21(2) in English, and which is hereby incorporated herein in its entirety by reference.

BACKGROUND OF THE INVENTION

The invention relates to recovery of cooking chemicals in pulp production processes based on organic chemicals, particularly in processes based on formic acid and acetic acid. In the process of the invention recovery of cooking acids is arranged to be carried out in conditions which enable production of more cooking acids from dissolved hemicellulose and lignin included in the used cooking liquor and simultaneous release of acids bound to the dissolved material by de-esterification to compensate for cooking chemical losses. At the same time furfural is formed, which is utilized as an extractant in the recovery of cooking chemicals by distillation.

The chemicals used in pulp production have to be recovered and reused as efficiently as possible for environmental, legislative and economic reasons. In conventional pulp production processes, where wood material is used as the raw material, recovery of cooking chemicals has been rather successful. One has also succeeded in reducing the amount of sulphur compounds in exhaust gases. In several countries, however, the limited availability of wood material constitutes a problem when production is to be increased, and thus attempts have been made to replace wood with non-wood fibre sources. However, in such straw pulp processes recovery of chemicals has not been successful. So far it has not been economically feasible to implement a pulp plant that would function according to the "total effluent free" principle.

In pulp production processes based on organic chemicals, efficient recovery of chemicals is particularly important because organic chemicals are typically more expensive than inorganic chemicals and thus efficiency of their recovery has a considerable influence on the economy of the whole process.

So far prior art processes based on organic chemicals have involved considerable chemical losses. Neither have the chemical recovery processes been that simple and inexpensive. The best-known pulp production processes based on organic compounds include Alcell, Organocell, Milox and Formacell processes.

In the recovery of chemicals the object is to enable as efficient and economic re-use of chemicals as possible without loading the environment.

The recovery of chemicals in pulp production processes based on organic acids and alcohols has been described e.g. in WO 93/15261 (Lora J. H. et al.), EP 0 584 675 A1 (Nimz, H. H. H. & Schöne, M.) and in Pohjanvesi, S. et al., Technical and economical feasibility study of the Milox process, The $8^{th}$ International Symposium on Wood and Pulping Chemistry, Jun. 6–9, 1995, Helsinki, vol. 2, pp. 231–236. In these prior art processes the recovery of acids is based on thermal separation processes and distillation.

Vapour-liquid equilibrium between organic acids and between furfural and organic acids as well as separation by distillation are described e.g. in Hunsmann, W. & Simmrock, K. H., Trennung von Wasser, Ameisensaure und Essigsäure durch Azeotrop Destillation, Chemie-Ingenieur-Technik 38 (19), 1966, pp. 1053–1059 and in Tsirlin, Yu. A., Studies of Liquid-Vapour Equilibrium in the System Furfural-Water-Acetic Acid, Zhurnal Prikladnoi Khimii 35 (1962), no.2, pp. 409–416.

Finnish application 980995 (WO 99/57364) (Chempolis Oy) describes a pulp production process based on formic acid and acetic acid and a process for regenerating cooking acid by evaporation and distillation. The concentrated cooking liquor is evaporated in a multi-phase evaporator to a concentration of dissolved solids of 50 to 80%, and water is distilled from diluted acids by means of overpressure to the typical total concentration of formic acid and acetic acid, i.e. 80 to 90%, and this mixed acid is returned to cooking.

Finnish application 973474 (WO 99/105959) (Chempolis Oy) describes a process for the recovery of chemically bound formic acid from pulp. The process utilizes free formic acid.

DEFINITIONS RELATED TO THE INVENTION

The expression "azeotrope" means a mixture whose equilibrium vapor and liquid compositions are equal. The azeotrope corresponds to an extremal point (minimum, maximum or saddle point) on the boiling temperature isobar or on the vapor pressure isotherm.

The expression "azeotropic distillation" means either distillation of azeotropic mixtures or distillation where an azeotrope-forming component (entrainer) is added to the process.

The expression "extractive distillation" means distillation where a relatively high-boiling, miscible component (entrainer) which does not form an azeotrope is added to the distillation column above the actual feed stream.

The expression "heteroazeotrope" means an azeotrope where the vapor phase coexists with two liquid phases.

The expression "heteroazeotropic distillation" means either distillation of heteroazeotropic mixtures or distillation where a heteroazeotrope-forming component (entrainer) is added to the process.

The expression "heteroazeotropic-extractive distillation" means combined heteroazeotropic and extractive distillation. The relatively high-boiling component to be added is selective and miscible with one or more components of the lower-boiling mixture to be separated and forms an azeotrope with one of the remaining components.

The expression "thermal separation processes" means separation of one or more components from a mixture containing them by means of heat utilizing the different boiling points of the components. Examples of thermal separation processes are evaporation and crystallization.

The expression "de-esterification" means ester hydrolysis, i.e. conversion of chemically bound acids from the ester form into free acids.

BRIEF DESCRIPTION OF THE INVENTION

The object of the invention is to provide a pulp production process based on organic chemicals where formation and recovery of cooking chemicals have been further improved. The invention is based on forming more cooking acids during the recovery phase of cooking chemicals from the dissolved organic substance included in the cooking liquor, such as hemicellulose or lignin, and releasing the acids chemically bound to the solids into the cooking liquor. The process also yields furfural, which is used in the recovery of cooking chemicals in the distillation phase. Formic acid, acetic acid and furfural are formed as the dissolved organic substance reacts. Acetic acid is formed from acetyl groups of plant raw material, for example. The catalytic activity of formic acid and other acids included in the mixture is utilized in the de-esterification and degradation of hemicellulose and lignin.

The object of the invention is achieved with a process which is characterized by what is disclosed in the independent claims. The preferred embodiments of the invention are disclosed in the dependent claims.

DETAILED DESCRIPTION OF THE INVENTION

Figure 1:
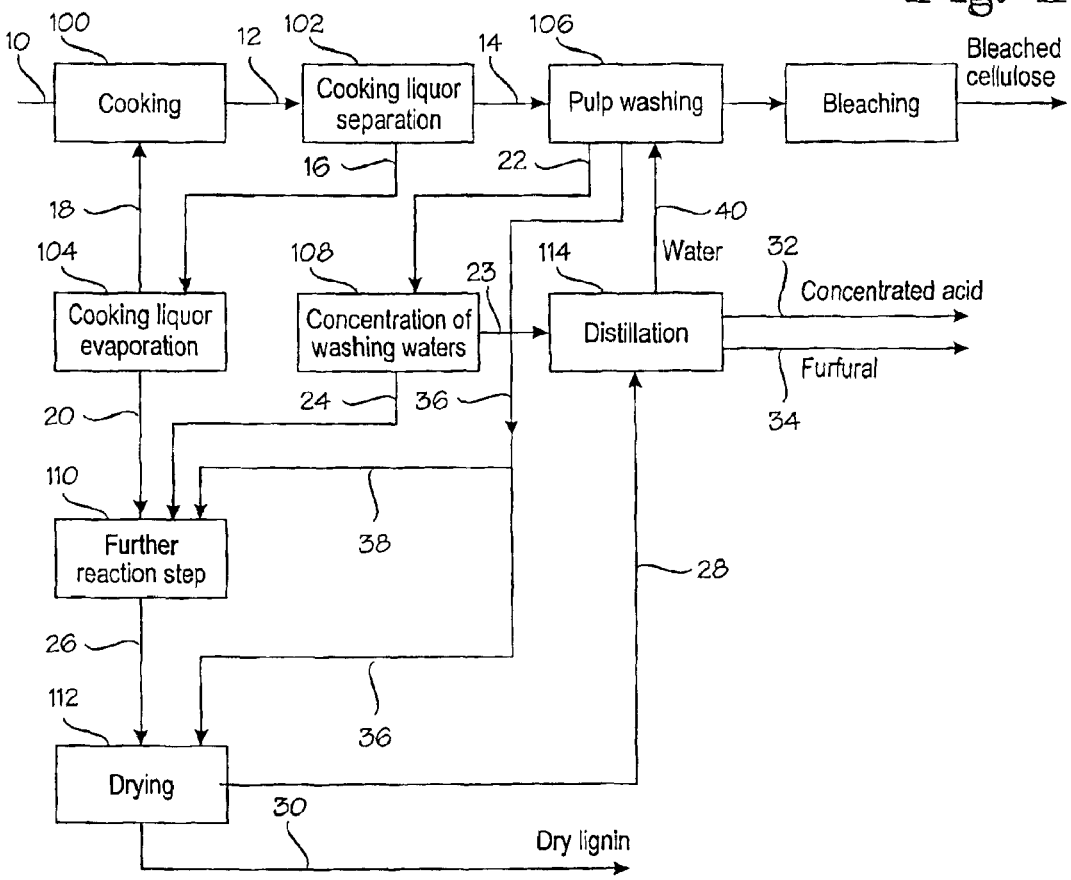
FIG. 1 illustrates an embodiment of the invention by means of a process chart.

The invention relates to a process for forming formic acid, acetic acid and furfural and for recovery of formic acid and acetic acid in a pulp production process where an acid mixture containing mainly formic acid and acetic acid is used as the cooking chemical, the process comprising a pulp cooking step, separation of cooking liquor from the pulp, pulp washing and a recovery step of cooking chemicals.

The process is characterized by a) evaporating the used cooking liquor obtained from separation of cooking liquor and pulp, which yields as a condensate a concentrated acid mixture which contains formic acid and acetic acid and is at least partly returned to the cooking, and as evaporation residue an evaporation concentrate, where acetic acid, formic acid and furfural have been formed in the evaporation from the organic substance included in the used cooking liquor and/or from the chemically bound acids included therein, b) separating the volatile part and the evaporation residue from the evaporation concentrate, c) separating a mixture of acetic acid and formic acid, water and furfural from the volatile part of the evaporation concentrate and possibly from part of the condensates from evaporation of the cooking liquor by distillation, which comprises an azeotropic-extractive distillation phase by utilizing the furfural formed and recovered in the process, d) returning the mixture of formic acid and acetic acid obtained from distillation to cooking, returning at least part of furfural to distillation of step (c), recovering the rest of furfural and returning water to pulp washing.

In connection with the present invention the expression "used cooking liquor" refers to cooking liquor which is obtained from cooking and from which pulp has been separated. In addition to the cooking chemicals, i.e. formic acid and acetic acid, and water, the used cooking liquor contains organic substance derived from the raw material of pulp. The organic substance included in the cooking liquor is mainly dissolved organic substance but the liquor may also contain solid fines. The dissolved organic substance in the cooking liquor mainly consists of hemicellulose and lignin, which has dissolved in the cooking liquor during cooking from the plant material used as the raw material for pulp. Hemicellulose contains pentoses, such as xylose.

The cooking chemical composition of the cooking liquor typically varies in the range of 40 to 80% of formic acid and 8 to 50% of acetic acid, the rest being water.

The process of the invention functions in any pulp production process based on organic acids. The process functions in a wide concentration range of acids and the recovery of chemicals does not limit the cooking acid concentrations in any way. The concentrations of formic acid and acetic acid may vary in the range where cooking is normally carried out. A cooking acid composition containing 40 to 80% of formic acid and 8 to 50%, preferably 10 to 40%, of acetic acid is typically used. However, the process of the invention also functions with cooking acid compositions which contain only either formic acid or acetic acid, i.e. the amount of formic acid and acetic acid may vary from 0 to 100%.

In the process according to the invention the used cooking liquor obtained from pulp separation is evaporated, typically at an elevated temperature. If low pressure is used, evaporation can also be performed at lower temperatures. The condensate obtained from the evaporation is a concentrated mixture of formic acid and acetic acid whose concentration is in a suitable range so that it can be returned to cooking as such. If necessary, some of the condensates obtained from the evaporation can be introduced into the distillation step to concentrate the acid mixture obtained as the condensate.

The evaporation residue of the cooking liquor is an evaporation concentrate where more formic acid, acetic acid and furfural have been formed during the evaporation from the dissolved organic substance included in the cooking liquor, i.e. mainly from hemicellulose and lignin. Organic acids, typically formic acid and acetic acid, have also been formed in the evaporation concentrate from the acids bound to the solids in the cooking liquor. These acids are typically in the form of esters. Thus de-esterification occurs during evaporation and more cooking acids are obtained for the evaporation concentrate through de-esterification, too.

The volatile part and the evaporation residue are separated from the evaporation concentrate.

A mixture of formic acid and acetic acid, and water and furfural are separated by distillation from the volatile part of the evaporation concentrate and possibly from part of the condensates from the cooking liquor evaporation. Distillation includes an azeotropic-extractive distillation phase utilizing the furfural formed and recovered in the process. Acetic acid, formic acid and furfural are recovered by distilling these from water using the furfural formed in the process as a distilling aid in the distillation. Distillation yields a mixture of acetic acid and formic acid which can be utilized as such in cooking.

The dry solids content of the used cooking liquor before the evaporation step (a) is typically in the range of 5 to 15%, which typically contains 10 to 45% of hemicellulose and 90 to 55% of lignin.

In step (a) the cooking liquor is typically evaporated to obtain a dry solids content of 20 to 85%, preferably 40 to 80%.

Evaporation of the cooking liquor in step (a) is typically performed at a temperature from 60 to 180° C., using low pressure or overpressure. The evaporation step (a) typically includes one or more phases, of which at least one is performed at a temperature over 100° C. Evaporation can be carried out by any conventional process.

Reacting of the evaporation concentrate can be monitored by measuring the xylose content of the concentrate. In that case formic acid, acetic acid and furfural are obtained as reaction products. The lower the xylose content in the concentrate, the more completely the organic substance included in the cooking liquor has reacted. If as large amounts of cooking chemicals and furfural as possible are to be produced, evaporation is continued until the concentrate does not substantially contain reacting organic substance, such as xylose. At the same time the cooking liquor is also de-esterified.

If it is not desirable to continue evaporation and there is still organic substance left, the evaporation concentrate obtained from step (a) can be reacted at an elevated temperature without evaporation with varying retention times (step (1a) of the process according to the invention). In that case more formic acid, acetic acid and furfural can be formed in the concentrate. This further reaction is typically performed at a temperature of 50 to 250° C. The reaction time is typically 0.5 min to 24 h. The further reaction can be carried out e.g. in a separate reactor. Also in this step the cooking liquor is de-esterified and formation of formic acid, acetic acid and furfural can be monitored by measuring the xylose content of the reaction mixture.

Alternatively, part of the condensates from the cooking liquor evaporation can be introduced into the distillation before the further reaction step.

The process of the invention may also contain step (a0), where water or diluted acid solution is added to the evaporation concentrate obtained from the evaporation of the cooking liquor. The water may be from different sections of the closed water circulation of the process and the diluted acid solution may be e.g. diluted wash acid mixture obtained either as such or in concentrated form from the pulp washing phase. In connection with the present invention, the expression "wash acids" refers to residual acids in the form of diluted water solution that have been left in the pulp in the separation step of cooking liquor and have thus ended up in the wash waters separated from the pulp. The wash waters may also contain small amounts of plant material-based organic substance.

When diluted acid mixture is added to the evaporation concentrate obtained from step (a), de-esterification can be further intensified as acids in the form of esters and chemically bound with the solids are released, and more cooking acids are formed in the mixture through de-esterification.

Wash acids can be concentrated e.g. by evaporation in the same manner as described above in connection with the evaporation of cooking acids. This yields as condensate a diluted acid mixture containing water, formic acid and acetic acid. An evaporation concentrate which can be added to the evaporation concentrate obtained from the cooking acid evaporation is obtained as the evaporation residue of wash acids.

In one embodiment of the invention the separation of step (b) is carried out by drying. The drying step typically takes place after steps (a), (a0) or (a1). The drying yields as volatile component, i.e. condensate, a mixture containing formic acid, acetic acid and furfural, and lignin as drying residue. All or part of the mixture of formic acid, acetic acid and furfural is introduced into distillation step (c), where the components are separated using furfural for separating water from the acids.

The drying step is typically performed at a temperature of 40 to 170° C. The drying time is typically 0.5 min to 24 h. The drying is typically performed up to a dry solids content of 75 to 99% of the drying residue, preferably 85 to 97%. More formic acid, acetic acid and furfural may be formed in the drying step, too, if the mixture to be dried still contains unreacted hemicellulose and lignin.

De-esterification can also be performed on the substance that has already been dried by adding water or diluted acid solution to the dried material (step (b2) of the process according to the invention). The de-esterified material is dried and/or re-evaporated after this.

The volatile part obtained from drying, i.e. the condensate, and possibly part of the condensates from the cooking liquor evaporation are distilled, which yields as product streams a cooking acid mixture containing formic acid and acetic acid, and water, furfural and acetic acid.

The distillation step (c) includes an azeotropic-extractive distillation phase utilizing furfural. Distillation is typically carried out in two or three phases, in which case the azeotropic-extractive distillation phase is typically the first phase of distillation. The other distillation phases are conventional distillations based on the different boiling points of the components to be separated.

The azeotropic-extractive distillation, preferably heteroazeotropic-extractive distillation, is typically performed in a pressure range of 0.2 bar to 8 bar. The most preferable pressure range is around 1 bar.

In the azeotropic-extractive distillation phase condensates, which contain water, formic acid, acetic acid and furfural and were obtained from phase (a1), (b) and/or (b2), are introduced into a first distillation column, possibly together with the condensates obtained from the concentration of the wash waters. This distillation column of the first distillation phase yields a mixture containing furfural and water as the top product and a mixture containing formic acid, acetic acid, water and furfural as the bottom product. The azeotropic-extractive distillation is typically performed near the normal atmospheric pressure or at a slight overpressure.

The mixture of furfural and water obtained as the top product from the first distillation phase is separated into a furfural fraction and a water fraction. The separation is typically carried out by decanting.

Part of the bottom product from the first distillation phase or all of it is introduced into the second distillation phase. A mixture containing formic acid and acetic acid, which is returned to cooking, is obtained as the top product from the second distillation phase. A mixture containing furfural and possibly acetic acid is obtained as the bottom product.

The bottom product obtained from the second distillation phase containing acetic acid and furfural is introduced into the third distillation phase, which yields acetic acid as the top product and furfural as the bottom product. The acetic acid obtained as a separate product stream is recovered and sold for use as a commercial product.

At least part of the furfural fraction obtained as the top product from the first distillation phase and/or of the furfural obtained as the bottom product from the second or third distillation phase is returned to the first distillation phase for use as a distilling aid in the distillation.

The returned furfural stream is introduced into a first distillation column, typically to a section above the feed stream containing water, formic acid, acetic acid and furfural.

The part of furfural that is not returned to distillation is recovered and utilized as a commercial product.

The process may also include a pre-concentration step before the evaporation phase of step (a).

The lignin product obtained from the drying phase can be cooled down and granulated.

The present invention utilizes acetic acid formed in the process from the plant raw material, typically from its acetyl groups. In the process the acetic acid content is allowed to concentrate so that in addition to formic acid the cooking liquor also contains acetic acid. In the recovery system of chemicals according to the invention distillation is carried out in a distillation range where concentration into a mixed acid directly suitable for cooking can be carried out easily. The binary azeotrope formed by water and formic acid and the ternary saddle azeotrope formed by water, formic acid and acetic acid divide this mixture into four distillation ranges, whose limits cannot be exceeded by direct conventional distillation. For this reason the products obtained by conventional distillation are not reusable in the process. According to the invention, this problem can be solved by utilizing the partial insolubility of water and furfural in each other, the pressure dependence of azeotropes, the extractive capability of furfural and the binary azeotrope formed by furfural and water. Thus heavy and complex column solutions can be avoided and separate concentration of the formic acid and acetic acid to be returned is unnecessary.

The recovery of acids according to the invention includes partial distillation of evaporation condensates where acids are concentrated and excess acetic acid is removed from the process.

In the evaporation and drying step of the process according to the invention acetic acid, formic acid and furfural are formed as decomposition products of the dissolved organic substance, which is de-esterified at the same time. When formates and acetates are further hydrolysed from the organic substance by adding water or diluted acid solution, organic acids and furfural are formed as the organic substance decomposes. The furfural formed in the process is used as the extractant of distillation in the concentration of acids. This has advantageous effects on the whole process since the acid losses can be minimized by means of the reactive separation operation, furfural can be produced in the process, furfural can be recovered as a valuable by-product in connection with the distillation of the acids, and furfural can be used as a distilling aid in the distillation.

The recovery and formation of acids according to the invention can in practice be carried out e.g. in the evaporation unit or drying unit used in the concentration of liquors or in a reactor/reactors arranged in connection with these units. The temperature range is typically 40 to 170° C. and the retention time 0.5 min to 24 h.

The distillation step of the process according to the invention utilizes the partial insolubility of water and furfural in each other, the pressure dependence of azeotropes, the extractive capability of furfural, and the binary azeotrope formed by furfural and water.

In the distillation section of the process according to the invention the acid mixture is concentrated to make it reusable in pulp production. At the same time water is purified so that it can be used in pulp washing. Furthermore, the furfural and acetic acid formed in the process are removed in as pure form as possible.

In the azeotropic-extractive process separation is carried out using a combination of azeotropic distillation and conventional extractive distillation. In the process furfural is simultaneously used as the extractant and as the azeotrope-forming agent for efficient separation of water from acids. Depending on the temperature, furfural forms with water either a homogenous azeotrope or a heterogenous azeotrope. At a temperature lower than 120° C. the azeotrope is heterogenous and thus in the corresponding pressure range, i.e. from low pressure to slight overpressure, the process is more precisely called heteroazeotropic-extractive distillation. In heteroazeotropic-extractive distillation of this kind the extractant has a double effect and it generates two liquid phases.

In the azeotropic-extractive distillation phase of the process according to the invention an extractant stream containing a large amount of furfural is introduced into the upper part of the first distillation column above the feed stream to be separated. A stream whose composition approaches the composition of furfural-water is obtained from the top of the column. This stream can be divided into water and furfural streams by decanting. A concentrated mixed acid which contains a large amount of furfural and whose water content can be reduced very low if necessary is obtained from the bottom of the column. The bottom product is introduced into the second column. Mixed acid to be returned to pulp production is obtained from the top of this column and a mixture of furfural and acetic acid from its bottom. This mixture is fed into a third column where acetic acid and furfural are separated from each other. The concentrated furfural stream obtained as the bottom product from the third column is used as the extractant stream in the first column or the furfural thus obtained is recovered for use as a commercial product. At least part of the furfural stream obtained from decanting of the first distillation phase is returned in the same manner to the first distillation phase for use as a distilling aid in the distillation.

The azeotropic-extractive distillation enables concentration of the mixed acid to the necessary concentration in a wide pressure range from low pressure to overpressure and makes this flexible. However, the process functions particularly well near the normal pressure (1 bar) or at a slight overpressure, i.e. as heteroazeotropic-extractive distillation. In that case investment and operating costs are advantageously lower. The pressure has no significant effect on the operation of the second and the third column.

In the following, the invention will be described by means of a non-restrictive process chart shown in FIG. 1.

In the process chart of FIG. 1, raw material 10 to be delignified, such as bagasse or reed canary grass, is fed to a cooking phase 100. Concentrated acid mixture 18 obtained from regeneration of cooking acid and containing mainly formic acid and acetic acid is also introduced into the cooking phase 100. The cooking phase is followed by a separation phase 102 of the cooking liquor where delignified pulp 14 is separated from the used cooking liquor. The separated cooking liquor 16 thus obtained is introduced into an evaporation phase 104, from which a concentrated mixture of formic acid and acetic acid, which is returned to the cooking phase 100, is obtained as condensate 18 and an evaporation concentrate 20 as evaporation residue where formic acid, acetic acid and furfural have been formed from the dissolved organic substance, which contains hemicellulose and lignin included in the cooking liquor. The evaporation concentrate 20 obtained from the evaporation phase is reacted at an elevated temperature without evaporation in a further reaction phase 110 where more formic acid, acetic acid and furfural can be formed in the reaction mixture from the dissolved organic substance included in the cooking liquor. At the same time the organic substance is de-esterified.

The delignified pulp 14 obtained from the separation of the cooking liquor is introduced into a pulp washing phase 106, and the wash acid mixture 22 obtained from pulp washing is introduced into a concentration phase 108 of wash acids, which yields a mixture 23 containing water and cooking acids as condensate and an evaporation concentrate 24 as evaporation residue. The condensate 23 is returned to distillation. The evaporation concentrate 24 obtained from the evaporation of wash acids is introduced into the same reactor as the evaporation concentrate 20 obtained from the evaporation of cooking acids for a further reaction 110, where a reaction mixture consisting of evaporation concentrates is reacted at an elevated temperature without evaporation, and thus more formic acid, acetic acid and furfural can be formed in the evaporation concentrate from the organic substance included in the evaporation concentrates. At the same time bound acids can be released by de-esterification.

The reaction mixture 26 thus obtained is dried in a drying phase 112, which yields water, formic acid, acetic acid and furfural as condensate 28, which are introduced into a distillation phase 114. Alternatively, the condensate 28 obtained from drying 112 can also be introduced into cooking 100. Dry lignin 30 is obtained as drying residue from drying.

Alternatively, the evaporation concentrate 24 can also be fed to the evaporation step 104.

In an alternative embodiment, non-concentrated wash acid mixture 36, 38 obtained from pulp washing can also be added to the further reaction step 110. Alternatively, the non-concentrated wash acid mixture 36 can also be fed to the evaporation phase 104.

The non-concentrated wash acid mixture 36 can also be added to the drying phase 112. It is also feasible to add the diluted wash acid mixture obtained from pulp washing to material that has already been dried and re-dry the aqueous mixture after further reactions.

The product streams obtained from the distillation step 114 are water 40, which is returned to pulp washing 106, a concentrated mixture 32 of acetic acid and formic acid, which is returned to cooking, and furfural 34, which is utilized as a distilling aid in the distillation.

Figure 2:
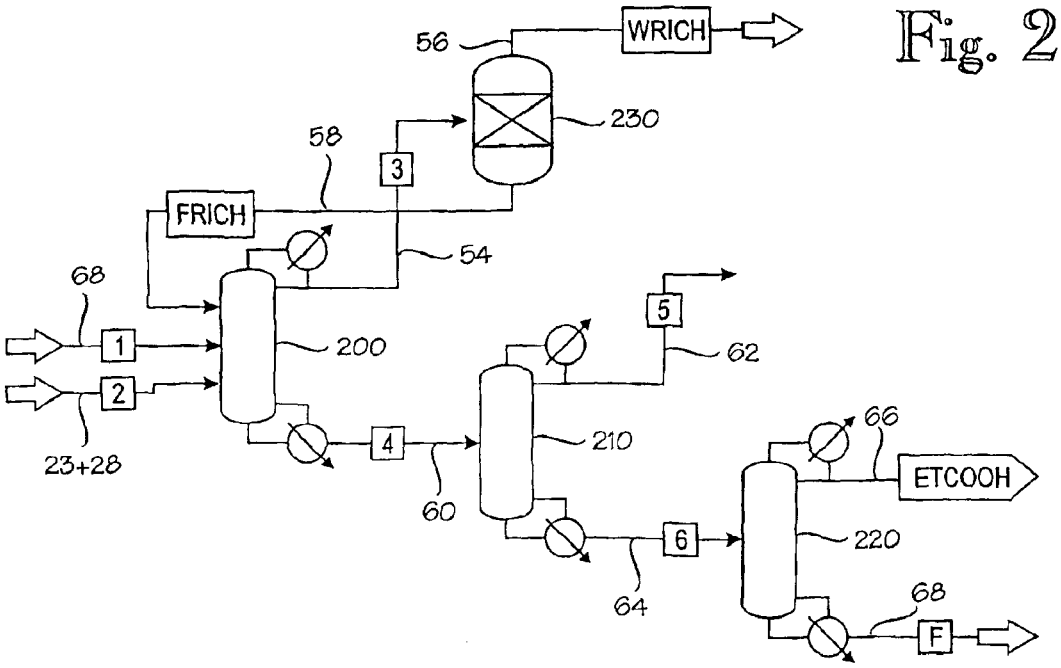
FIG. 2 illustrates a practical embodiment of the distillation step included in the process according to the invention as a flow chart.

FIG. 2 illustrates in greater detail a practical embodiment of the distillation step of the process according to the invention as a flow chart. Condensate 23 obtained from the evaporation of wash acids and condensate 28 obtained from the drying phase of the cooking liquor containing water, formic acid, acetic acid and furfural are introduced into the first distillation column 200. A furfural stream 68 returned from the third distillation column is also introduced into the first distillation column. A mixture containing furfural and water is obtained as the top product 54 from the first distillation column 200, which is separated in a decanter 230 into a water fraction 56 (Wrich) and a furfural fraction 58 (Frich). The water fraction is returned to pulp washing and the furfural fraction 58 into distillation for use as a distilling aid in the distillation by feeding furfural to the first distillation column 200 above the feed streams 23 and 28 containing water, formic acid, acetic acid and furfural.

The bottom product 60 obtained from the first distillation column 200, which contains water, formic acid, acetic acid and furfural, is introduced into the second distillation column 210, from which a mixture of formic acid and acetic acid, which is returned to cooking, is obtained as the top product 62, and a mixture containing acetic acid and furfural as the bottom product 64. The latter mixture 64 is introduced into the third distillation column 220, from which acetic acid (EtCOOH) is obtained as the top product 66 of the distillation and furfural (F) as the bottom product 68. Furfural is returned to the first distillation phase. Furfural can also be sold for use as a commercial product.

Preferably herbaceous plants and hardwood are used as the raw material in the process according to the invention. Herbaceous plants generally refer to non-wood fibre sources. The most important fibre sources include straw, e.g. grain straw (rice, wheat, rye, oats, barley); hay, e.g. esparto, sabai and lemon hay; reeds, e.g. papyrys, common reed; sugar cane, i.e. bagasse and bamboo; bast fibres, e.g. stems of common flax and oil flax, kenaf, jute and hemp; leaf fibres, e.g. manilla hemp and sisal, and seed hair, such as cotton and linter fibres of cotton. One important raw material that grows in Finland is reed canary grass.

The process of the invention is also applicable to wood material.

In the following, the invention will be described by non-restrictive examples.

EXAMPLE 1

Bagasse was cooked using a cooking acid mixture containing 42% of formic acid and 40% of acetic acid. The cooking liquor (initial dry solids content approx. 5%) was separated from delignified bagasse pulp and concentrated by evaporation at a temperature of 62 to 70° C. to a dry solids content of 24.2%, the furfural content of the cooking liquor being 0.3% and the amount of xylose in the dry solids 37.3%. The concentrated cooking liquor was evaporated on pilot scale using a single-phase thin film evaporator at a pressure of 0.2 bar at different temperatures. The contents of dry solids, xylose and furfural were measured from the evaporation concentrate. The results are shown in Table 1 (the xylose contents have been calculated from the dry solids).

TABLE 1

| Jacket temperature (° C.) | Concentrate Xylose (% by wt.) | Concentrate Furfural (% by wt.) |
|---|---|---|
| 130 | 21.4 | 0.6 |
| 150 | 19.3 | 0.6 |
| 160 | 16.9 | 0.7 |
| 170 | 10.5 | 1.1 |

It appears from the results that xylose is decomposed and furfural formed. The results also show that the decomposition of xylose depends on the temperature.

A concentrated mixture of formic acid and acetic acid was obtained as the condensate from evaporation.

TABLE 2

| | Bound HCOOH (% by w.) | Bound AcOH (% by w.) | Free xylose (% by w.) |
|---|---|---|---|
| Feed | 2.3 | 9.1 | 25.3 |
| Product | 1.0 | 3.1 | 1.4 |

The results show that xylose included in the concentrate decomposes as in Example 1. This can be seen as formation of furfural. It was also noticed that de-esterification occurs.

EXAMPLE 3

Bagasse-containing cooking liquor (initial dry solids content approx. 5%), which had been concentrated by evaporation to a dry solids content of 28%, was reacted at a temperature of 130° C. in laboratory reactors. Samples were taken from the reactor contents, from which the contents of furfural, xylose, formic acid, acetic acid and solids and the amount of bound acids were analysed at the beginning and at the end of the reaction. The measurement results are shown in Tables 3a and 3b. Table 3a illustrates how the xylose, furfural and dry solids contents changed in the reactor tests and Table 3b illustrates acid formation in the reactor tests (xylose contents were calculated from the dry solids). In Table 3b the expression "acids formed" refers to the acids that were formed as a result of the decomposition.

TABLE 3a

| | Solids (% by wt.) | Xylose (% by wt.) | Furfural (% by wt.) |
|---|---|---|---|
| At the beginning | 27.7 | 20.0 | 1.2 |
| At the end | 21.0 | 5.7 | 5.4 |

TABLE 3b

| | Free Acids | | | | Bound Acids | | |
|---|---|---|---|---|---|---|---|
| | c(acid) | | | | c(acid) | | |
| | At the beginning | At the end | Formed | | At the beginning | At the end | Acids formed |
| | [g/l] | [g/l] | [g/l] | [% by wt.][a] | [% by wt.][b] | | [% by wt.][a] |
| HCOOH | 317 | 330 | 13 | 4.7 | 4.0 | 2.1 | 2.3 |
| AcOH | 267 | 292 | 25 | 9.0 | 7.4 | 4.4 | 5.0 |

[a]calculated from the original amount of dry solids
[b]calculated from the given amount of dry solids

EXAMPLE 2

Bagasse-containing cooking liquor (initial dry solids content approx. 5%) was concentrated as described in Example 1 and evaporated in a pilot evaporator at a pressure of 0.2 bar. The dry solids content of liquor was 35.7%. The evaporator was heated by a rotating steam coil. The contents (% by weight of the dry solids) of bound acids, i.e. formic acid (HCOOH) and acetic acid (AcOH), and xylose were measured from the feed and product concentrates. The results are shown in Table 2.

It appears from Tables 3a and 3b that xylose is decomposed, furfural is formed, the liquor is de-esterified and the dry solids decomposed. It was found that acids are also formed by means other than de-esterification.

EXAMPLE 4

Concentrated reed canary grass-containing cooking liquor (dry solids content approx. 7.5%) was mixed with a water solution containing 10% of formic acid, and the mixture was reacted at a temperature of 120° C. in laboratory tests. Samples were taken from the reactor contents, from which formic acid and acetic acid contents and the amount of bound acids were analysed. The measurement results are shown in Table 4.

TABLE 4

| | Free acids | | | | Bound acids | | |
|---|---|---|---|---|---|---|---|
| | c(acid) | | | | c(acid) | | Formed |
| | t = 1 h | t = 6 h | Formed | | t = 1 h | | acids |
| | [g/l] | [g/l] | [g/l] | [% by wt.][a] | [% by wt.][b] | t = 6 h | [% by wt.][a] |
| HCOOH | 134 | 146 | 12 | 6.0 | 1.9 | 0.7 | 4.8 |
| AcOH | 15 | 24 | 9 | 4.5 | 3.1 | 0.2 | 1.6 |

[a]calculated from the original amount of dry solids
[b]calculated from the given amount of dry solids It appears from Table 4 that by mixing water (in the form of diluted acid mixture) with the cooking liquor, the amount of bound acids can be reduced low and at the same time formic acid and acetic acid can be formed through decomposition reactions.

EXAMPLE 5

This example describes the distillation of condensates obtained from the evaporation of wash acids and drying of cooking liquor as heteroazeotropic-extractive distillation using three distillation columns (see Table 5).

A mixture of condensates obtained from the evaporation of wash acids and drying of the cooking liquor is fed to the first distillation column. The mixture contains 56 mol-% of water, 23 mol-% of formic acid, 18 mol-% of acetic acid and 3 mol-% of furfural. The mixture is fed at a flow rate of 31 t/h. Furfural (=bottom product from the third distillation column) is also fed to the first distillation column at a flow rate of 10 t/h. The pressure in the first distillation column was about 1 bar. A mixture of water and furfural is obtained as the top product of the distillation and a mixture containing water, formic acid, acetic acid and furfural as the bottom product.

Water and furfural are separated from the top product of the first column by decanting. The bottom product of the first column is introduced into the second distillation column, from which a mixture of formic acid, acetic acid and water is obtained as the top product. The bottom product of the second distillation column is introduced into the third column, from which acetic acid is separated as the top product and furfural as the bottom product. Furfural is returned to the first column for use as a distilling aid in the distillation.

Table 5 shows the compositions and flow rates of the feed and the products from different distillation phases.

TABLE 5

| | Column 1 | | | | | |
|---|---|---|---|---|---|---|
| | | Top | Bottom | Decanting | | Column 2 |
| Flow | Feed | product | product | Water | Furfural | Top product |
| Flow rate [t/h] | 31 | 11 | 32 | 8 | 1 | 22 |
| c(water) [mol-%] | 56 | 92 | 20 | 98 | 18 | 25 |

TABLE 5-continued

| | Column 1 | | | | | |
|---|---|---|---|---|---|---|
| | | Top | Bottom | Decanting | | Column 2 |
| Flow | Feed | product | product | Water | Furfural | Top product |
| c(HCOOH) [mol-%] | 23 | — | 35 | — | — | 44 |
| c(AcOH) [mol-%] | 18 | — | 26 | — | — | 30 |
| c(furfural) [mol-%] | 3 | 8 | 19 | 2 | 82 | 1 |

It is obvious to a person skilled in the art that as the technology advances, the inventive concept can be implemented in various ways. The invention and its embodiments are thus not limited to the examples described above, but they may vary within the scope of the claims.

What is claimed is:

1. A process for recovering formic acid, acetic acid and furfural and simultaneously forming same in a pulp production process where an acid mixture containing mainly formic acid and acetic acid is used as a cooking liquor, the cooking liquor is separated from the pulp, the pulp is washed, and the cooking liquor is subjected to a recovery phase, wherein the recovery phase comprises a) evaporating the used cooking liquor obtained from the separation of cooking liquor and pulp and including an organic substance and/or a chemically bound organic acids, wherein the evaporation yields as condensate a concentrated acid mixture which contains formic acid and acetic acid and is at least partly returned to the cooking, and as a first evaporation residue an evaporation concentrate, where acetic acid, formic acid and furfural have formed in the evaporation from the organic substance included in the used cooking liquor and/or from the chemically bound acids included therein, b) separating the evaporation concentrate into a volatile part and a second evaporation residue, c) separating the volatile part of the evaporation concentrate obtained in step (b) and/or part of the condensate obtained in step (a) into four fractions comprising a mixture of acetic acid and formic acid, water, furfural and acetic acid by distillation, which comprises an azeotropic-extractive distillation phase by utilizing the furfural formed and recovered in the process as a distillation aid, wherein the azeotropic-extractive distillation phase comprises introducing the volatile part of the evaporation concentrate obtained in step (b) and/or the condensate obtained in step (a) and including acetic acid, formic acid, furfural and water feedstream into a first distillation column and recovering a mixture of furfural and water as the top product of the distillation and a concentrated mixture of acetic acid and formic acid containing also water and furfural as the bottom product of the distillation, followed by separating the top product of the distillation to recover water and furfural and distilling the bottom product of the distillation to recover a mixture of acetic acid and formic acid, water, furfural and acetic acid, and, d) returning the mixture of formic acid and acetic acid obtained from the distillation to cooking, returning at least part of furfural to the distillation of step (c), recovering the rest of furfural and acetic acid and returning water to pulp washing.

2. A process according to claim 1, wherein the evaporation step (a) is carried out to a dry solids content of 20 to 85%.

3. A process according to claim 2 wherein the evaporation step is carried out to a dry solids content of 40 to 80%.

4. A process according to claim 1, wherein the evaporation step (a) is carried out at a temperature of 60 to 180° C. at overpressure or at low pressure.

5. A process according to claim 4, wherein the evaporation step (a) is carried out in one or more phases, of which at least one is carried out at a temperature higher than 100° C.

6. A process according to claim 1, wherein the evaporation concentrate further comprises xylose, wherein the formation of formic acid, acetic acid and furfural is monitored by measuring the xylose content of the evaporation concentrate.

7. A process according to claim 6, wherein the evaporation is continued until the evaporation concentrate does not substantially contain xylose.

8. A process according to claim 1, wherein the process also includes, before the separation step (b), step (a1) where the evaporation concentrate obtained from step (a) is reacted at an elevated temperature without evaporation, as a result of which more formic acid, acetic acid and furfural are formed in the evaporation concentrate.

9. A process according to claim 8, wherein the temperature is 50 to 250° C.

10. A process according to claim 8, wherein the reaction time is 0.5 min to 24 h.

11. A process according to claim 8, wherein the evaporation concentrate further comprises xylose, wherein the formation of formic acid, acetic acid and furfural is monitored by measuring the xylose content of the evaporation concentrate.

12. A process according to claim 11, wherein the reaction is continued until the reaction mixture does not substantially contain xylose.

13. A process according to claim 8, wherein the process also includes, before step (a1), step (a0) where water or diluted acid solution is added to the evaporation concentrate.

14. A process according to claim 13, wherein the diluted acid solution is wash acid mixture obtained from pulp washing.

15. A process according to claim 14, wherein the wash acid mixture is concentrated wash acid mixture.

16. A process according to claim 1, wherein the separation of step (b) is carried out by drying, which yields as volatile component a mixture which contains water, formic acid, acetic acid and furfural and is introduced into the distillation step (c), and lignin as drying residue.

17. A process according to claim 16, wherein the lignin residue obtained from drying is cooled down and granulated.

18. A process according to claim 16, wherein drying is carried out at a temperature of 40 to 170° C.

19. A process according to claim 16, wherein the drying time is 0.5 min to 24 h.

20. A process according to claim 16, wherein drying is carried out to a dry solids content of 75 to 99% of the drying residue.

21. A process according to claim 20, wherein drying is carried out to a dry solids content of 85 to 97% of the drying residue.

22. A process according to claim 16, wherein after the drying step the process also comprises step (b2) where water or diluted acid solution is added to the drying residue and the mixture thus obtained is dried and/or re-evaporated.

23. A process according to claim 22, wherein the diluted acid solution is a wash acid mixture obtained from pulp washing.

24. A process according to claim 23, wherein the wash acid mixture is a concentrated wash acid mixture.

25. A process according to claim 1, wherein separation of the top product of the distillation is performed by decanting.

26. A process according to claim 1, wherein part or all of the bottom product from the first distillation phase is introduced into a second distillation phase where a mixture of formic acid and acetic acid, which is returned to cooking, is obtained as the top product of distillation and a furfural-containing mixture as the bottom product.

27. A process according to claim 26, wherein the bottom product also contains acetic acid.

28. A process according to claim 27, wherein the bottom product obtained from the second distillation phase and containing acetic acid and furfural is introduced into a third distillation phase, from which acetic acid is obtained as the top product and furfural as the bottom product.

29. A process according to claim 1, further comprising second and third distillation phases, wherein a stream of at least part of the furfural separated as the top product of the first distillation phase and/or of the furfural obtained as the bottom product from the second or third distillation phase is returned to the first distillation column and the rest is recovered.

30. A process according to claim 29, wherein the returned furfural stream is introduced into the first distillation column above the feed stream containing water, formic acid, acetic acid and furfural.

31. A process according to claim 1, wherein water from separation of the top product is returned to pulp washing.

32. A process according to claim 1, wherein the process also comprises a pre-concentration step before the evaporation phase of step (a).

* * * * *